US006656059B2

(12) United States Patent
Umezawa et al.

(10) Patent No.: US 6,656,059 B2
(45) Date of Patent: Dec. 2, 2003

(54) MULTI-PIECE SOLID GOLF BALL

(75) Inventors: Junji Umezawa, Chichibu (JP); Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/145,777

(22) Filed: May 16, 2002

(65) Prior Publication Data

US 2003/0060307 A1 Mar. 27, 2003

(30) Foreign Application Priority Data

May 23, 2001 (JP) ..... 2001-154456

(51) Int. Cl.[7] ..... A63B 37/06
(52) U.S. Cl. ..... 473/373
(58) Field of Search ..... 473/370, 371, 473/373, 374, 378, 383, 384

(56) References Cited

U.S. PATENT DOCUMENTS 5,145,180 A * 9/1992 Oka ..... 473/382
5,553,852 A 9/1996 Higuchi et al.
5,899,822 A 5/1999 Yamagishi et al.
6,129,640 A * 10/2000 Higuchi et al. ..... 473/374
6,334,820 B1 * 1/2002 Sasaki ..... 473/374
6,390,936 B1 * 5/2002 Sugimoto ..... 473/374
2001/0031669 A1 * 10/2001 Ohama ..... 473/371
2002/0019273 A1 * 2/2002 Ohama ..... 473/376
2002/0098917 A1 * 7/2002 Iwami ..... 473/374

FOREIGN PATENT DOCUMENTS

JP 07024085 A 1/1995
JP 10151226 A 6/1998

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A multi-piece solid golf ball includes an elastic solid core, a resinous intermediate layer and a resinous cover. When subjected to a load of 1274 N (130 kgf) from an initial load of 98 N (10 kgf), the solid core undergoes a deformation A, a sphere consisting of the solid core and the intermediate layer undergoes a deformation B, and the golf ball undergoes a deformation C, all expressed in millimeter, which satisfy the relationship: $1.14 \leqq A/B \leqq 1.30$ and $1.05 \leqq B/C \leqq 1.16$. This combination of features provides the ball with qualities desired by professional golfers and skilled amateurs, including spin and flight performances.

7 Claims, 1 Drawing Sheet

MULTI-PIECE SOLID GOLF BALL

BACKGROUND OF THE INVENTION

1. Field of the Invention

The present invention relates to a multi-piece solid golf ball comprising an elastic solid core, a resinous cover enclosing the core and a resinous intermediate layer therebetween having different physical properties, which ball provides excellent spin and flight performances.

2. Background Art

Multi-piece solid golf balls having an elastic solid core and a cover composed of at least two layers have already been proposed as golf balls which meet the requirements of professionals and other skilled golfers. For example, JP-A 7-24085 discloses a golf ball with an inside hard/outside soft cover construction in which the inner cover layer has a greater hardness than the outer cover. JP-A 10-15 1226 discloses a multi-piece solid golf ball of the same type which has an improved spin performance, durability and flight distance.

However, such improvements remain inadequate. A need continues to be felt for golf balls having certain qualities desired in particular by professionals and other skilled golfers, such as better spin performance when hit with an iron or on approach shots and better flight performance.

SUMMARY OF THE INVENTION

It is therefore an object of the invention to provide a multi-piece solid golf ball in which the deformations of ball components under increasing load conditions simulating the deformation of the ball on actual shots are optimized so as to improve flight performance and spin performance when hit with an iron and on approach shots.

This invention is directed to a multi-piece solid golf ball comprising an elastic solid core, a resinous cover enclosing the core and formed with a plurality of dimples, and a resinous intermediate layer between the core and the cover. The elastic solid core, a sphere consisting of the solid core and the intermediate layer enclosing the core, and the golf ball (as a completed article having the solid core enclosed with the intermediate layer and the cover) each undergo a deformation when the load applied thereto is increased from an initial load of 98 N (10 kgf) to a final load of 1274 N (130 kgf). Provided that A, B and C represent the deformations that the solid core, the sphere consisting of the solid core and the intermediate layer enclosing the core, and the golf ball undergo, respectively, the deformations of the respective components are adjusted so as to satisfy the relationship: $1.14 \leqq A/B \leqq 1.30$ and $1.05 \leqq B/C \leqq 1.16$. Then the deformations of the ball components under increasing load conditions simulating the deformation of the ball upon actual shots are mutually optimized, and the deformation of the golf ball is properly balanced throughout the ball. Due to synergistic effects of the optimization combined with the good balance, the multi-piece solid golf ball has excellent flight performance and improved spin performance when hit with an iron and on approach shots.

Accordingly, the invention provides a multi-piece solid golf ball comprising an elastic solid core, a resinous cover enclosing the core and formed with a plurality of dimples, and a resinous intermediate layer between the core and the cover. When subjected to a load of 1274 N (130 kgf) from an initial load of 98 N (10 kgf), the solid core undergoes a deformation A, a sphere consisting of the solid core and the intermediate layer enclosing the core undergoes a deformation B, and the golf ball undergoes a deformation C, all expressed in millimeter, which satisfy the relationship:

$$1.14 \leqq A/B \leqq 1.30$$

and $$1.05 \leqq B/C \leqq 1.16.$$

In a preferred embodiment, the cover is composed primarily of a thermoplastic or thermosetting polyurethane elastomer. The intermediate layer is preferably made of a resin composition comprising at least 70 parts by weight of ionomer resin, more preferably a resin composition comprising:

(a) 100 parts by weight of an olefin/unsaturated carboxylic acid random copolymer, an olefin/unsaturated carboxylic acid/unsaturated carboxylic acid ester random copolymer, a metal ion neutralization product of either type of copolymer, or a mixture of any of the copolymers and the neutralization products thereof;

(b) 5 to 80 parts by weight of a fatty acid having a molecular weight of at least 280 or a derivative thereof; and (c) 0.1 to 10 parts by weight of a basic inorganic metal compound capable of neutralizing the acid groups in components (a) and (b).

Preferably, the dimples have a V0 value of up to 0.47. V0 is the volume of a dimple space below a plane circumscribed by the dimple edge divided by the volume of a cylinder whose bottom is the plane and whose height is the maximum depth of the dimple from the bottom.

DETAILED DESCRIPTION OF THE INVENTION

Figure 1:
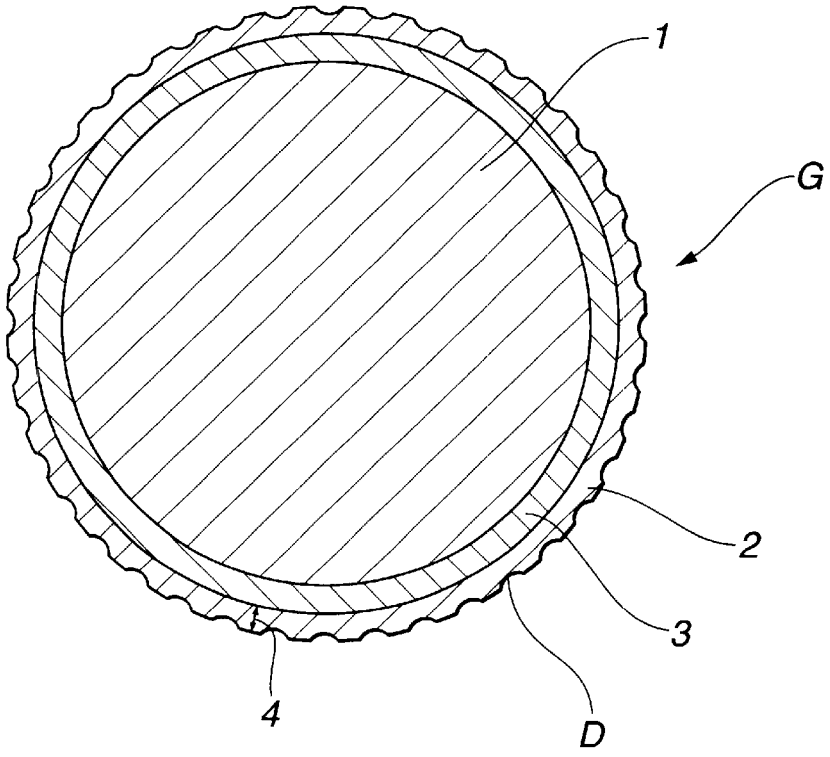
FIG. 1 is a sectional view showing a golf ball according to one embodiment of the invention.

The multi-piece solid golf ball of the invention has a construction composed of at least three layers which include, as in the three-piece golf ball G shown in FIG. 1, an elastic solid core 1, a cover 2, and an intermediate layer 3. The cover 2 is formed on its surface with a plurality of dimples D.

The elastic solid core may be produced from a known material, and is preferably made of a rubber composition. The rubber composition is preferably one in which polybutadiene is used as the base material. 1,4-Polybutadiene having a cis structure of at least 40% is preferred. If desired, other rubbers such as natural rubber, polyisoprene rubber or styrene-butadiene rubber may be suitably blended into the base rubber. The rebound energy of the golf ball can be improved by increasing the amount of the rubber components.

Curing agents that may be compounded in the rubber composition include the zinc and magnesium salts of unsaturated fatty acids, such as zinc dimethacrylate and zinc diacrylate, and ester compounds such as trimethylol-propane methacrylate. The use of zinc diacrylate is especially preferred. It is advantageous to include the curing agent in an amount of at least 10 parts by weight, and preferably at least 20 parts by weight, but not more than 50 parts by weight, and preferably not more than 39 parts by weight, per 100 parts by weight of the base rubber.

A crosslinking agent is generally compounded in the rubber composition. It is recommended that the crosslinking agent include a peroxide having a one minute half-life temperature of not more than 155° C. in an amount of at least 20% by weight, and preferably at least 30 wt %, based on the overall amount of crosslinking agent. Although there is no particular upper limit on the amount of peroxide used, an amount no greater than 70 wt % is preferred. Examples of suitable peroxides include commercially available products such as Percumyl D and Perhexa 3M (manufactured by NOF Corp.) and Luperco 231XL (manufactured by Atochem Co.). It is advantageous for the amount of crosslinking agent included in the rubber composition to be at least 0.2 part by weight, and especially at least 0.6 part by weight, but not more than 2.0 parts by weight, and especially not more than 1.5 parts by weight, per 100 parts by weight of the base rubber.

If necessary, other suitable ingredients may also be incorporated in the rubber composition, such as antioxidants and specific gravity-adjusting fillers, e.g., zinc oxide and barium sulfate.

It is particularly advantageous to include an organosulfur compound in the rubber composition. Exemplary organosulfur compounds include thiophenols, thionaphthols, halogenated thiophenols, and metal salts thereof. Specific examples of suitable organosulfur compounds include halogenated thiophenols such as pentachlorothiophenol, pentafluorothiophenol, pentabromothiophenol, p-chlorothiophenol and the zinc salt of pentachlorothiophenol; and polysulfides having two to four sulfur atoms, such as diphenyl polysulfides, dibenzyl polysulfides, dibenzoyl polysulfides, dibenzothiazoyl polysulfides and dithiobenzoyl polysulfides. The zinc salt of pentachlorothiophenol and diphenyl disulfide are especially preferred. Such an organosulfur compound is typically included in an amount of at least 0.3 parts by weight, and preferably at least 0.5 parts by weight, but not more than 2 parts by weight, and preferably not more than 1.2 parts by weight, per 100 parts by weight of the base rubber. Too little of this ingredient tends to lower the rebound energy and the core hardness, whereas too much may make the core excessively soft, deadening the feel of the ball on impact and worsening its durability (cracking resistance) when repeatedly struck with a club.

The rubber composition may be vulcanized and cured by a known method to form the elastic solid core. It is recommended for flight performance that the solid core be formed to a diameter of at least 35.6 mm, preferably at least 36 mm, and most preferably at least 36.2 mm, but not more than 39 mm, preferably not more than 38 mm, and most preferably not more than 37 mm.

The elastic solid core undergoes a deformation A when the load applied thereto is increased from an initial load of 98 N (10 kgf) to a final load of 1274 N (130 kgf), which deformation must be optimized relative to the deformations of the other ball components as will be described later. The deformation of the solid core under the increasing load conditions is preferably at least 3.2 mm, more preferably at least 3.4 mm, and most preferably at least 3.6 mm, but not more than 5.0 mm, and more preferably not more than 4.1 mm.

It is recommended that the elastic solid core at its center have a JIS-C hardness of up to 67, preferably up to 66, and more preferably up to 65. The lower limit of the JIS-C hardness at the center is recommended to be at least 56, preferably at least 59, and more preferably at least 61. It is also recommended that the elastic solid core at its surface have a JIS-C hardness of up to 80, preferably up to 78, and more preferably up to 76. The lower limit of the JIS-C hardness at the surface is recommended to be at least 65, preferably at least 67, and more preferably at least 69. Outside the upper and lower limits of hardness, there is a likelihood that the desired flight performance be lost or the feel upon impact become too hard. The hardness distribution of the core extending radially outward from its center to its surface is preferably such that hardness gradually increases from the center to the surface. A substantially flat hardness distribution (in a radially outward direction) is acceptable insofar as the objects of the invention are not impaired.

The intermediate layer of the inventive golf ball may be made of well-known materials. It is recommended that the intermediate layer be made of a resin composition which includes at least 70 parts by weight, and preferably at least 80 parts by weight, of ionomer resin, provided that the base resin is 100 parts by weight.

The intermediate layer material is preferably a resin composition containing components (a) to (c) below as the essential constituents:

(a) an olefin/unsaturated carboxylic acid random copolymer, an olefin/unsaturated carboxylic acid/unsaturated carboxylic acid ester random copolymer, a metal ion neutralization product of either type of copolymer, or a mixture of any of the copolymers and the neutralization products thereof;

(b) a fatty acid having a molecular weight of at least 280 or a derivative thereof; and (c) a basic inorganic metal compound capable of neutralizing the acid groups within components (a) and (b).

The resin composition in which above components (a) to (c) serve as the essential constituents has a good thermal stability, flow properties and moldability, and is capable of imparting resilience to the intermediate layer.

Olefins in component (a) generally have at least 2 carbons. The upper limit in the number of carbons is generally 8, and preferably 6. Examples of suitable olefins include ethylene, propylene, butene, pentene, hexene, heptene and octene. Ethylene is especially preferred.

Examples of suitable unsaturated carboxylic acids include acrylic acid, methacrylic acid, maleic acid and fumaric acid. Acrylic acid and methacrylic acid are especially preferred.

Suitable unsaturated carboxylic acid esters include lower alkyl esters of the above-described unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Of these, butyl acrylate (n-butyl acrylate, i-butyl acrylate) is especially preferred.

Random copolymers which may serve as component (a) can be prepared by random copolymerization of the foregoing ingredients according to a known method. It is recommended that the amount of unsaturated carboxylic acid included in the random copolymer, also referred to below as the "acid content," be generally at least 2% by weight, preferably at least 6% by weight, and most preferably at least 8% by weight, but not more than 25% by weight, preferably not more than 20% by weight, and most preferably not more than 15% by weight. At too low an acid content, the rebound energy may decrease, whereas too high an acid content may result in a decline in durability.

Random polymer neutralization products which may serve as component (a) can be prepared by partially neutralizing the acid groups on the random copolymer with metal ions. Suitable examples of metal ions for neutralizing the acid groups include $Na^+$, $K^+$, $Li^+$, $Zn^{2+}$, $Cu^{2+}$, $Mg^{2+}$, $Ca^{2+}$, $Co^{2+}$ $Ni^{2+}$ and $Pb^{2+}$. Of these, $Na^+$, $Li^+$, $Zn^{2+}$ and $Mg^{2+}$ are preferred, and $Zn^{++}$ is especially preferred. The degree to which the random copolymer is neutralized by these metal ions is not subject to any particular limitation. Such neutralization products may be prepared by a known method, such as one involving the use of a compound containing the metal ion to be introduced onto the random copolymer, such as a formate, acetate, nitrate, carbonate, bicarbonate, oxide, hydroxide or alkoxide thereof.

In working the invention, the intermediate layer material is prepared by blending predetermined amounts of components (b) and (c) with the base resin serving as component (a). It is recommended that at least 50 mol %, preferably at least 60 mol %, more preferably at least 70 mol %, and most preferably at least 80 mol %, of the acid groups in the resulting mixture be neutralized. A higher degree of neutralization more reliably suppresses the undesirable exchange reactions that arise with use of the base resin and a fatty acid (or derivative) alone, making it possible to preclude regeneration of fatty acid and achieve a material having a greatly increased thermal stability, a good moldability and a much higher resilience than conventional ionomer resins.

Illustrative examples of component (a) include Nucrel AN4311, AN4318 and AN1560 (all produced by DuPont-Mitsui Polychemicals Co., Ltd.); Himilan 1554, 1557, 1601, 1605, 1706, 1855, 1856 and AM7316 (all products of DuPont-Mitsui Polychemicals Co., Ltd.); and Surlyn 6320, 7930, 8120, 8940, 9910, 9945 and 8945 (all products of E.I. DuPont de Nemours and Company). Zinc ion-neutralized ionomer resins, such as Himilan AM7316, are especially preferred.

Component (b) is a fatty acid or fatty acid derivative with a molecular weight of at least 280. This component, which has a much lower molecular weight than component (a), enhances the flow characteristics of the resin composition and greatly increases the melt viscosity of the intermediate layer material. Also, because the fatty acid or fatty acid derivative has a molecular weight of at least 280 and a high content of acid groups or derivative moieties thereof, it is able to suppress the loss of resilience.

The fatty acid or fatty acid derivative of component (b) may be an unsaturated fatty acid or fatty acid derivative thereof having a double bond or triple bond in the alkyl group, or it may be a saturated fatty acid or fatty acid derivative in which all the bonds on the alkyl group are single bonds. It is recommended that the number of carbons on the molecule be generally at least 18, preferably at least 20, and most preferably at least 22, but not more than 80, preferably not more than 60, more preferably not more than 40, and most preferably not more than 30. Too few carbons may make it impossible to achieve an improved heat resistance, and may also set the acid group content so high as to cause the acid groups to interact with acid groups present in component (a), diminishing the flow-enhancing effect. On the other hand, too many carbons increases the molecular weight, which may also lower the flow-enhancing effect.

Specific examples of fatty acids that may be used as component (b) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Fatty acid derivatives which may be used as component (b) include derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$,$Pb^{2+}$ and $Co^{2+}$. Of these, $Ca^{2+}$, $Mg^{2+}$ and $Zn^{2+}$ are preferred.

Specific examples of fatty acid derivatives that may be used as component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Component (c) is a basic inorganic metal compound capable of neutralizing the acid groups in above components (a) and (b).

For the purposes of the present invention, component (c) may be any basic inorganic metal compound capable of neutralizing the acid groups in above components (a) and (b). However, the use of a hydroxide is especially desirable because the high reactivity of hydroxides and the absence of organic compounds in the reaction by-products enable the degree of neutralization in the intermediate layer material to be increased without a loss of thermal stability.

Metal ions that may be used in the basic inorganic metal compound include $Li^+$, $Na^+$, $K^+$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$, $Sn^{2+}$, $Pb^{2+}$ and $Co^{2+}$. Examples of suitable inorganic metal compounds include basic inorganic metal compounds containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a hydroxide is preferred. The use of calcium hydroxide, which has a high reactivity with component (a), and especially ionomer resins, is most preferred.

A known mixing method may be employed to prepare the intermediate layer material for the inventive golf ball. However, when above components (a) to (c) are compounded, it is recommended that they be combined in relative proportions of 100 parts by weight of component (a); generally at least 5 parts by weight, but not more than 80 parts by weight, preferably not more than 40 parts by weight, and most preferably not more than 20 parts by weight, of component (b); and at least 0.1 part by weight, but not more than 10 parts by weight, and preferably not more than 5 parts by weight, of component (c). Too little component (b) lowers the melt viscosity, resulting in a poor processability. Too little component (c) fails to improve thermal stability and resilience, whereas too much actually lowers the heat resistance of the composition due to the presence of excess basic inorganic metal compound.

The intermediate layer can be formed by any well-known method, for example, injection molding or heat compression molding. It is recommended that the intermediate layer have a (radial) thickness of at least 0.6 mm, and preferably at least 0.8 mm, while the upper limit of thickness be up to 2.0 mm, and preferably up to 1.8 mm.

Though not critical, it is recommended that the intermediate layer have a Shore D hardness of at least 58, preferably at least 60, but up to 68, preferably up to 66. If the intermediate layer is too soft, the ball may receive more spin on shots and thus travel short and give a too soft feel upon impact. If the intermediate layer is too hard, there may be drawbacks including less spin, less control, a hard feel, less durability (cracking resistance) upon repetitive shots.

According to the invention, a sphere consisting of the elastic solid core and the intermediate layer enclosing the core undergoes a deformation B when the load applied thereto is increased from an initial load of 98 N (10 kgf) to a final load of 1274 N (130 kgf), which is properly correlated to the deformations A and C of the elastic solid core and the golf ball, as will be described later. The deformation of the sphere under the increasing load conditions is preferably at least 2.5 mm, more preferably at least 2.7 mm, but not more than 3.5 mm, and more preferably not more than 3.3 mm.

To ensure that the objects of the invention be achieved, the sphere consisting of the elastic solid core enclosed with the intermediate layer preferably has a coefficient of restitution (COR) of at least 0.80, and more preferably at least 0.81. It is noted that coefficient of restitution (COR) is measured by firing a ball (herein, the sphere consisting of the elastic solid core enclosed with the intermediate layer) in a pneumatic cannon at a velocity (referred to as firing velocity, equal to 38.1 m/s or 125 feet/s) against a steel plate which is positioned apart from the muzzle of the cannon. The rebound velocity is then measured. The rebound velocity is divided by the firing velocity to give the coefficient of restitution. A COR value which is more approximate to unity (1) indicates higher resilience.

The cover may be formed of well-known materials. Exemplary are materials based on thermoplastic resins and thermosetting resins. Most often, thermoplastic and thermosetting polyurethane elastomers are used as the base material in the cover. If necessary, a filler such as barium sulfate may be added to the elastomers for use as the cover material.

A thermoplastic polyurethane elastomer having a tan $\delta$ peak temperature, in the measurement of viscoelasticity, not higher than −15° C., and especially not higher than −16° C., but not lower than −50° C., is preferred from the standpoint of flexibility and resilience.

A reaction product between the thermoplastic polyurethane elastomer and an isocyanate compound may also be used as the cover material in the invention. A material of this type makes it possible to further enhance the surface durability against iron shots.

Commercial products may be used as the thermoplastic polyurethane elastomer and include those in which the diisocyanate is aliphatic or aromatic, such as Pandex T7298, T7295, T7890 and TR3080 (all manufactured by DIC Bayer Polymer Co., Ltd.).

The cover can be formed by any well-known method, for example, injection molding or heat compression molding. It is recommended that the cover have a (radial) thickness of at least 0.6 mm, and preferably at least 0.8 mm, while the upper limit of thickness be up to 2.0 mm, and preferably up to 1.6 mm. As shown in FIG. 1, the cover thickness 4 refers to the thickness extending radially from the surface of intermediate layer 3 to land areas, or areas free of dimples D, on the cover's surface.

In the golf ball of the invention, the intermediate layer and the cover have a combined thickness, defined as (cover thickness+intermediate layer thickness), of at least 1.2 mm, and preferably at least 1.5 mm, but not more than 3.5 mm, and preferably not more than 3.2 mm. Too small a combined thickness results in poor cracking resistance when the ball is repeatedly hit, whereas too large a combined thickness lowers the rebound energy of the ball, resulting in a shorter carry.

The cover should preferably have a Shore D hardness of at least 44, preferably at least 46, and most preferably at least 48, but not more than 56, and preferably not more than 55. It is recommended that the cover have a lower Shore D hardness than the intermediate layer. Too soft a cover may sometimes have the effect of increasing the spin rate when the ball is shot with various clubs, resulting in a shorter carry and an excessively soft feel upon impact. On the other hand, a cover that is too hard may sometimes lead to drawbacks including a low spin rate, reduced controllability, a hard feel on impact and low durability (cracking resistance) against repetitive hits.

In the practice of the invention, the cover should desirably be formed to a lower hardness (or softer) than the intermediate layer. It is recommended that the cover and the intermediate layer have a difference in Shore D hardness of generally at least 7, and preferably at least 9, but not more than 16, and preferably not more than 14. Too small a hardness difference may lead to insufficient spin on iron and approach shots whereas an excessive hardness difference tends to lower the durability of the ball.

If necessary, an adhesive layer may be provided between the intermediate layer and the cover to improve adhesion therebetween, and to enhance durability at the time of impact. Examples of suitable adhesives include epoxy resin adhesives, vinyl resin adhesives and rubber-based adhesives, although the use of a urethane resin-based adhesive or a chlorinated polyolefin-based adhesive is especially preferred. Commercial products that are well-suited for this purpose include Resamine D6208 (a urethane resin-based adhesive manufactured by Dainichi Seika Colour & Chemicals Mgf. Co., Ltd.) and RB182 Primer (a chlorinated polyolefin-based adhesive manufactured by Nippon Bee Chemical Co., Ltd.).

The adhesive layer may be formed by dispersion coating. No particular limitation is imposed on the type of emulsion used for dispersion coating. The resin powder used for preparing the emulsion may be a thermoplastic resin powder or a thermosetting resin powder. Illustrative examples of suitable resins include vinyl acetate resin, vinyl acetate copolymer resins, ethylene-vinyl acetate (EVA) copolymer resins, acrylate polymer or copolymer resins, epoxy resins, thermosetting urethane resins, and thermoplastic urethane resins. Of these, epoxy resins, thermosetting urethane resins, thermoplastic urethane resins and acrylate polymers or copolymers are preferred. A thermoplastic urethane resin is especially preferred.

It is desirable for the adhesive layer to have a thickness of at least 0.1 $\mu$m, preferably at least 0.2 $\mu$m, and most preferably at least 0.3 $\mu$m, but not more than 30 $\mu$m, preferably not more than 25 $\mu$m, and most preferably not more than 20 $\mu$m.

Any suitable known process may be used to manufacture the multi-piece solid golf ball of the invention. For ease of operation and other reasons, it is especially advantageous to make use of a process in which the elastic solid core is molded under pressure and vulcanized, following which the molded core is placed in an injection mold-and the intermediate layer material and the cover material are successively injected over the core in accordance with a selected technique to form an intermediate layer and a cover.

According to the invention, the golf ball having the elastic solid core enclosed with the intermediate layer and the cover (completed article of core+intermediate layer+cover) undergoes a deformation C when the load applied thereto is increased from an initial load of 98 N (10 kgf) to a final load of 1274 N (130 kgf), which is properly correlated to the deformations A and B of the elastic solid core and the sphere (consisting of the solid core enclosed with the intermediate layer), as will be described later. The deformation of the ball under the increasing load conditions is preferably at least 2.3 mm, more preferably at least 2.4 mm, and most preferably at least 2.5 mm, but not more than 3.3 mm, and more preferably not more than 3.1 mm.

Provided that the solid core undergoes a deformation A, the sphere having the solid core enclosed with the intermediate layer undergoes a deformation B, and the golf ball (completed article having the elastic solid core enclosed with the intermediate layer and the cover) undergoes a deformation C., when the load applied thereto is increased from an initial load of 98 N (10 kgf) to a final load of 1274 N (130 kgf), the multi-piece solid golf ball of the invention requires that both the ratio of the deformation of the solid core to the deformation of the sphere, i.e., A/B and the ratio of the deformation of the sphere to the deformation of the golf ball, i.e., B/C be optimized.

Specifically, the ratio of the deformation A of the solid core to the deformation B of the sphere having the solid core enclosed with the intermediate layer, i.e., A/B must be at least 1.14, preferably at least 1.16 and up to 1.30, preferably up to 1.28. Too low an A/B ratio fails to provide the desired flight performance. Too high an A/B ratio may lead to too high hardness and hence, a poor feel and detract from durability against cracking.

The ratio of the deformation B of the sphere having the solid core enclosed with the intermediate layer to the deformation C of the golf ball (completed article having the elastic solid core enclosed with the intermediate layer and the cover), i.e., B/C must be at least 1.05, preferably at least 1.07 and up to 1.16, preferably up to 1.14. Too low a B/C ratio leads to excessive spin, undesired flight performance, and sometimes susceptibility to scuffing. Too high a B/C ratio leads to poor spin performance.

To ensure that the objects of the invention be achieved, the golf ball preferably has a coefficient of restitution (COR) of at least 0.79, and more preferably at least 0.8. The definition and measurement of COR is as previously defined.

The multi-piece solid golf ball of the invention has a plurality of dimpled formed on the surface of the cover. It is recommended that V0 be up to 0.47 and at least 0.42, provided that V0 is the volume of a dimple space below a plane circumscribed by the dimple edge divided by the volume of a cylinder whose bottom is the plane and whose height is the maximum depth of the dimple from the bottom.

Figure 2:
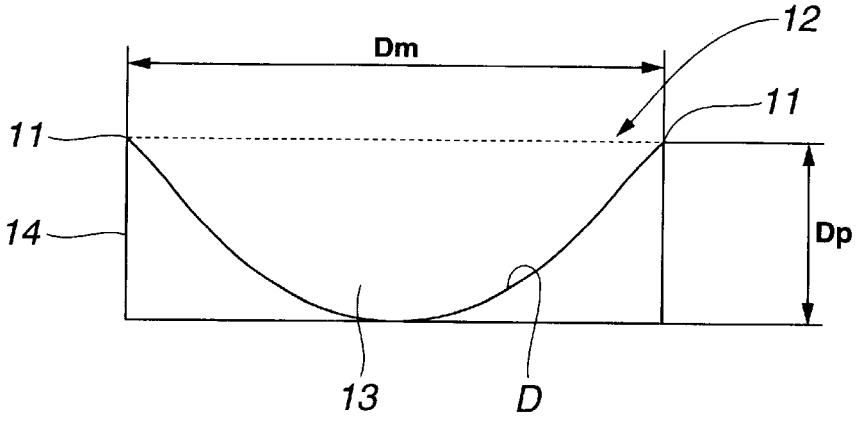
FIG. 2 is a schematic cross-sectional view of a dimple having a maximum diameter Dm and a maximum depth Dp, illustrating how to calculate V0.

The V0 value is described in further detail. Reference is made to a typical dimple whose planar shape is circular. In the cross section of FIG. 2 as viewed radially with respect to the ball center, a dimple D has an edge 11 at its highest point and in transition to the land. The dimple edge 11 circumscribes a plane 12 (a circle having a diameter Dm). The dimple space 13 located below the plane 12 has a volume Vp. A cylinder 14 whose bottom is the plane 12 and whose height is the maximum depth Dp of the dimple from the plane 12 has a volume Vq. The ratio V0 of the dimple space volume Vp to the cylinder volume Vq is calculated (V0=Vp/Vq).

No particular limits are imposed on the total number, shape, size and type of dimples on the golf ball. Usually the total number of dimples is 360 to 460. The arrangement of dimples may be the same as on conventional golf balls. There may be included dimples of two or more types which differ in diameter and/or depth, preferably two to four types. It is recommended that the dimples have a diameter of 2.0 to 5.0 mm and a depth of 0.05 to 0.25 mm.

The multi-piece solid golf ball of the invention can be manufactured such as to have a diameter and weight which conform with the Rules of Golf for competitive use. That is, the ball may be given a diameter of at least 42.67 mm and a weight of not more than 45.93 g.

The inventive golf ball provides increased carry and has excellent spin characteristics on shots with an iron and on approach shots. In addition, it has a good cracking resistance when repeatedly hit, good durability to topping, good scuff resistance, and a pleasant feel on impact. This combination of qualities provides the golf ball with the excellent performance desired in particular by professionals and other skilled golfers.

EXAMPLES

Examples of the invention and comparative examples are given below by way of illustration, and are not intended to limit the invention.

Examples 1–5 and Comparative Examples 1–4

Three-piece solid golf balls were manufactured by enclosing an elastic solid core with an intermediate layer and a cover while forming dimples on the cover surface. Table 1 shows the formulation of core materials and Table 2 shows the formulation of intermediate layer and cover materials used in the ball samples of Examples and Comparative Examples. Table 3 shows the combination and physical properties of the solid core, intermediate layer and cover as well as the test results of the ball samples.

The materials mentioned in the tables are described below.

Polybutadiene (1): BR11, manufactured by JSR Corporation.

Polybutadiene (2): BR19, manufactured by JSR Corporation.

Peroxide (1): Dicumyl peroxide, manufactured by NOF Corporation under the trade name Percumyl D.

Peroxide (2): 1,1-bis(t-butylperoxy)-3,3,5-trimethylcyclohexane, manufactured by NOF Corporation under the trade name Perhexa 3M-40.

Antioxidant: Produced by Ouchi Shinko Chemical Industry Co., Ltd. under the trade name Nocrack NS-6.

Adhesive: RB-182 Primer, produced by Nippon Bee Chemical Co., Ltd.

Thickness of adhesive layer: 3 $\mu$m

Surlyn: An ionomer resin manufactured by E.I. DuPont

Himilan: An ionomer resin manufactured by DuPont-Mitsui Polychemicals Co., Ltd.

AM7317: A zinc ionomer resin produced by DuPont-Mitsui Polychemicals Co., Ltd. Acid content, 18%.

AM7318: A sodium ionomer resin produced by DuPont-Mitsui Polychemicals Co., Ltd. Acid content, 18%.

Nucrel: An ethylene-methacrylic acid-acrylate copolymer made by DuPont-Mitsui Polychemicals Co., Ltd.

Pandex: A thermoplastic polyurethane elastomer manufactured by Dainippon Ink & Chemicals, Inc.

Behenic acid: NAA222-S beads produced by NOF Corporation.

Calcium hydroxide: CLS-B produced by Shiraishi Kogyo Co., Ltd.

Dynalon: A block copolymer in the form of hydrogenated butadiene-styrene copolymer manufactured by JSR Corporation.

The properties of the golf balls obtained in the examples were measured or evaluated as described below.

Deformation under Load:

The deformation (mm) under loading from 98 N to 1274 N was measured.

Flight Performance:

Rated as follows, based on the carry of the ball when it was struck at a head speed of 45 m/s with a driver (#1W) mounted on a swing machine.

Good: 223 m or more

Poor: less than 223 m

Spin When Hit with Sand Wedge on Approach Shot:

Rated as follows, based on the spin rate of the ball when it was struck at a head speed of 20 m/s with a sand wedge (SW) mounted on a swing machine.

Good: 6,000 rpm or more

Fair: at least 5,600 rpm but less than 6,000 rpm

Poor: less than 5,600 rpm

Feel:

The feel of the ball when hit with clubs (driver and putter) was rated as follows by three professional golfers.

Good: Good feel on impact

Poor: Too hard

Scuff Resistance:

A ball was struck once at a head speed of 45 m/s with a pitching wedge mounted in a swing machine, and the degree of scuffing incurred by the ball was visually evaluated. Three judges were used to rate the balls. A rating of "Good" indicates that at least two of the judges felt the ball could be used again, and a rating of "Poor" indicates that one or none of the judges felt the ball could be used again.

Good: Ball can be used again

Poor: Ball cannot be reused

TABLE 1

| | | Core type | | | |
|---|---|---|---|---|---|
| | | A | B | C | D |
| Core formulation (pbw) | Polybutadiene (1) | 70 | 70 | 70 | 70 |
| | Polybutadiene (2) | 30 | 30 | 30 | 30 |
| | Zinc diacrylate | 26 | 28 | 30 | 23 |
| | Peroxide (1) | 0.6 | 0.6 | 0.6 | 0.6 |
| | Peroxide (2) | 0.6 | 0.6 | 0.6 | 0.6 |
| | Antioxidant | 0.2 | 0.2 | 0.2 | 0.1 |
| | Zinc oxide | 21.2 | 20.3 | 19.5 | 31.2 |
| | Zinc salt of pentachlorothiophenol | 1 | 1 | 1 | 0.2 |
| | Zinc stearate | 5 | 5 | 5 | 0 |
| Vulcanization conditions | Temperature (° C.) | 157 | 157 | 157 | 157 |
| | Time (min) | 15 | 15 | 15 | 15 |

TABLE 2

| | | ① | ② | ③ | ④ | ⑤ | ⑥ | ⑦ | ⑧ | ⑨ |
|---|---|---|---|---|---|---|---|---|---|---|
| Formulation (pbw) | Himilan 1706 | 50 | | 42.5 | | | | | | |
| | Himilan 1557 | | 50 | | | | 50 | | | |
| | Himilan 1605 | 50 | | 42.5 | 35 | | | | | |
| | Himilan 1601 | | 50 | | | | 50 | | | |
| | Surlyn 9945 | | | | 35 | | | | | |
| | AM7317 | | | | | 50 | | | | |
| | AM7318 | | | | | 50 | | | | |
| | Nucrel AN4318 | | | 15 | | | | | | |
| | Dynalon 6100P | | | | 30 | | | | | |
| | Pandex T-7298 | | | | | | | 100 | 75 | 30 |
| | Pandex T-R3080 | | | | | | | | 25 | 70 |
| | Behenic acid | 20 | 20 | 20 | | | | | | |
| | Calcium hydroxide | 2.4 | 2.8 | 2.8 | | | | | | |
| | Titanium dioxide | | | | 1.5 | 5 | 2.4 | 4 | 4 | 4 |
| | Dicyclohexylmethane-4,4'-diisocyanate | | | | | | | 1.5 | 1.5 | 1.5 |
| Shore D hardness | | 63 | 60 | 61 | 56 | 66 | 58 | 50 | 47 | 43 |

TABLE 3

| | | Example | | | | | Comparative Example | | | |
|---|---|---|---|---|---|---|---|---|---|---|
| | | 1 | 2 | 3 | 4 | 5 | 1 | 2 | 3 | 4 |
| Solid Core | Type | A | A | B | A | B | A | A | B | D |
| | Diameter (mm) | 36.46 | 36.46 | 36.44 | 36.46 | 36.44 | 37.05 | 36.46 | 37.22 | 36.40 |
| | Weight (g) | 29.42 | 29.42 | 29.38 | 29.42 | 29.38 | 30.71 | 29.42 | 31.26 | 30.85 |
| | A: hardness @ 98-1274N (mm) | 3.89 | 3.89 | 3.50 | 3.89 | 3.50 | 3.87 | 3.89 | 3.45 | 3.85 |
| | Center JIS-C hardness | 64 | 64 | 66 | 64 | 66 | 64 | 64 | 66 | 64 |
| | Surface JIS-C hardness | 73 | 73 | 77 | 73 | 77 | 73 | 73 | 77 | 73 |
| Intermediate layer | Type | ① | ② | ③ | ③ | ③ | ④ | ⑤ | ② | ④ |
| | Shore D hardness | 63 | 60 | 61 | 61 | 61 | 56 | 66 | 60 | 60 |
| | Thickness (mm) | 1.62 | 1.63 | 1.63 | 1.80 | 1.63 | 1.35 | 1.82 | 1.63 | 1.65 |
| Solid core + | Diameter (mm) | 39.69 | 39.72 | 39.70 | 40.05 | 39.70 | 39.74 | 40.09 | 40.48 | 39.70 |

TABLE 3-continued

| | | | Example | | | | | Comparative Example | | | |
|---|---|---|---|---|---|---|---|---|---|---|---|
| | | | 1 | 2 | 3 | 4 | 5 | 1 | 2 | 3 | 4 |
| intermediate layer | Weight (g) | | 36.49 | 36.52 | 36.60 | 37.41 | 36.60 | 36.74 | 37.50 | 38.67 | 38.00 |
| | B: hardness @ 98-1274N (mm) | | 3.23 | 3.31 | 2.95 | 3.22 | 2.95 | 3.41 | 2.98 | 2.97 | 3.40 |
| | COR @ 125 feet/s | | 0.818 | 0.810 | 0.815 | 0.811 | 0.815 | 0.807 | 0.821 | 0.809 | 0.806 |
| Adhesive layer between cover and intermediate layer | | | yes | yes | yes | yes | yes | yes | yes | yes | no |
| Cover | Type | | ⑦ | ⑦ | ⑦ | ⑦ | ⑧ | ⑦ | ⑦ | ⑨ | ⑥ |
| | Thickness (mm) | | 1.49 | 1.48 | 1.50 | 1.32 | 1.50 | 1.47 | 1.30 | 1.13 | 1.50 |
| | Shore D hardness | | 50 | 50 | 50 | 50 | 47 | 50 | 50 | 50 | 58 |
| | Dimple V0 | | 0.45 | 0.45 | 0.45 | 0.45 | 0.45 | 0.45 | 0.45 | 0.45 | 0.45 |
| Ball | Diameter (mm) | | 42.67 | 42.67 | 42.69 | 42.68 | 42.70 | 42.68 | 42.69 | 42.74 | 42.70 |
| | Weight (g) | | 45.34 | 45.31 | 45.53 | 45.23 | 45.52 | 45.54 | 45.23 | 45.45 | 45.40 |
| | C: hardness @ 98-1274N (mm) | | 2.85 | 2.96 | 2.62 | 2.87 | 2.66 | 3.12 | 2.62 | 2.86 | 2.85 |
| | COR @ 125 feet/s | | 0.803 | 0.796 | 0.801 | 0.797 | 0.799 | 0.799 | 0.807 | 0.797 | 0.797 |
| Deformation ratio | A/B | | 1.20 | 1.18 | 1.19 | 1.21 | 1.19 | 1.13 | 1.31 | 1.16 | 1.13 |
| | B/C | | 1.13 | 1.12 | 1.13 | 1.12 | 1.11 | 1.09 | 1.14 | 1.04 | 1.19 |
| Ball Performance | #1W/ HS45 | Carry (m) | 206.9 | 206.5 | 206.3 | 205.6 | 205.2 | 203.9 | 207.7 | 203.4 | 206.1 |
| | | Total (m) | 225.6 | 224.1 | 225.9 | 224.7 | 223.2 | 221.4 | 225.8 | 220.2 | 225.5 |
| | | Spin (rpm) | 2624 | 2688 | 2726 | 2639 | 2751 | 2724 | 2581 | 2883 | 2618 |
| | | Flight performance rating | Good | Good | Good | Good | Good | Poor | Good | Poor | Good |
| | SW/ HS20 | Spin (rpm) | 6058 | 6090 | 6194 | 6060 | 6427 | 6172 | 5981 | 6684 | 5576 |
| | | Spin rating | Good | Good | Good | Good | Good | Good | Fair | Good | Poor |
| | Feel | #1W | Good | Good | Good | Good | Good | Good | Good | Good | Good |
| | | Putter | Good | Good | Good | Good | Good | Good | Good | Good | Poor |
| | Durability | Scuff resistance | Good | Good | Good | Good | Good | Good | Poor | Good | Good |

As is apparent from the results in Table 3, the golf balls according to the invention all had an excellent flight performance, excellent approach shot characteristics, a pleasant feel, excellent durability, and a good spin performance. By contrast, the golf balls obtained in the comparative examples showed an unbalance of properties. The balls of Comparative Examples 1 and 3 had a poor flight performance (carry). The balls of Comparative Examples 2, 4 and 5 were good in carry, but the balls of Comparative Example 2 showed poor durability (scuff resistance); and the balls of Comparative Examples 4 and 5 gave a hard feel upon impact.

Japanese Patent Application No. 2001-154456 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising an elastic solid core, a resinous cover enclosing the core and formed with a plurality of dimples, and an intermediate layer between the core and the cover, wherein said intermediate layer is made of a resin composition comprising at least 70 parts by weight of ionomer resin; the resin composition being comprised of:

(a) 100 parts by weight of an olefin/unsaturated carboxylic acid random copolymer, an olefin/unsaturated carboxylic acid/unsaturated carboxylic acid ester random copolymer, a metal ion neutralization product of either type of copolymer, or a mixture of any of the copolymers and the neutralization products thereof;

(b) 5 to 80 parts by weight of a fatty acid having a molecular weight of at least 280 or a derivative thereof;

(c) 0.1 to 10 parts by weight of a basic inorganic metal compound capable of neutralizing the acid groups in components (a) and (b); and wherein when subjected to a load of 1274 N (130 kgf) from an initial load of 98 N (10 kgf), the solid core undergoes a deformation A, a sphere consisting of the solid core and the intermediate layer enclosing the core undergoes a deformation B, and the golf ball undergoes a deformation C, all expressed in millimeters, which satisfy the relationship:

$$1.14 \leqq A/B \leqq 1.30 \text{ and}$$

$$1.05 \leqq B/C \leqq 1.16.$$

2. The multi-piece solid golf ball of claim 1 wherein the cover is composed primarily of a thermoplastic or thermosetting polyurethane elastomer.

3. The multi-piece solid golf ball of claim 1 wherein the dimples have a V0 value of up to 0.47, provided that V0 is the volume of a dimple space below a plane circumscribed by the dimple edge divided by the volume of a cylinder whose bottom is the plane and whose height is the maximum depth of the dimple from the bottom.

4. The multi-piece solid golf ball of claim 1, wherein said intermediate layer has a thickness of at least 0.6 to 2.0 mm.

5. The multi-piece solid golf ball of claim 1, wherein said intermediate layer and said cover have a combined thickness of 1.2 to 3.5 mm.

6. The multi-piece solid golf ball of claim 1, wherein said intermediate layer has a Shore D hardness of 58 to 68.

7. The multi-piece solid golf ball of claim 6, wherein said cover has a Shore D hardness of 44 to 56 which is lower than the hardness of said intermediate layer.

* * * * *